166-66 SR

9/22/87 XR 4,694,902

United States Patent [19]

Hörmansdörfer

[11] Patent Number: 4,694,902

[45] Date of Patent: Sep. 22, 1987

[54] PROCEDURE AND DEVICE FOR DETERMINING THE JAMMING POINT OF A PIPE LINE IN A DRILL HOLE

[76] Inventor: Gerd Hörmansdörfer, Kastanieneck 6 A, 3167 Burgdorf-Beinhorn, Fed. Rep. of Germany

[21] Appl. No.: 850,266

[22] Filed: Apr. 10, 1986

[30] Foreign Application Priority Data

Apr. 10, 1985 [DE] Fed. Rep. of Germany ..... 3512767
Feb. 18, 1986 [DE] Fed. Rep. of Germany ..... 3605036

[51] Int. Cl.[4] ..... E21B 47/00

[52] U.S. Cl. ..... 166/250; 166/66; 73/151

[58] Field of Search ..... 166/250, 255, 301, 65.1, 166/66, 66.5; 73/151, 779

[56] References Cited

U.S. PATENT DOCUMENTS 2,814,019 11/1957 Bender ..... 166/250 X
2,817,808 12/1957 Gieske ..... 166/250 X
3,115,774 12/1963 Kolb ..... 73/151
3,453,876 7/1969 Radus ..... 73/779 X
3,686,943 8/1972 Smith ..... 73/151
4,105,071 8/1978 Nicolas et al. ..... 166/66 X
4,351,186 9/1982 Moulin ..... 73/151
4,515,010 5/1985 Weido et al. ..... 166/66 X

FOREIGN PATENT DOCUMENTS 0039278 8/1983 European Pat. Off. .
0055675 3/1985 European Pat. Off. .
2335249 7/1972 Fed. Rep. of Germany .
3031997 11/1982 Fed. Rep. of Germany .
2742590 11/1983 Fed. Rep. of Germany .
3518161 11/1986 Fed. Rep. of Germany .

*Primary Examiner*—Stephen J. Novosad
*Attorney, Agent, or Firm*—Robert B. Chickering; Glen R. Grunewald

[57] ABSTRACT

The procedure of the invention for determining the jamming point of a pipe line in a drill hole is characterized by applying a constant torsional and/or tensile force to the jammed pipe above ground while a device made according to the invention called a free point probe travels through the pipe at constant speed. The free point probe includes one or two magneto strictive analyzers, which are held by spring pressure against the inner side of the pipe to be examined. During the travel of the free point probe, ideally when pulling it up, the compressive and tensile stresses resulting from the forces acting upon the pipe are read by the analyzer(s) in one area of the inner surface of the pipe and translated into proportional measurement signals. At the same time, the forces acting upon the pipe are measured above ground by means of appropriate receptors. The signals thus obtained are registered and corrected with the help of a data processing system above ground. The results show two independent values of torque and tensile force for a given depth of the pipe, in the form of a log.

18 Claims, 5 Drawing Figures

PROCEDURE AND DEVICE FOR DETERMINING THE JAMMING POINT OF A PIPE LINE IN A DRILL HOLE

The invention concerns a procedure and a device for determining the jamming point of a pipe line, for example tubing, casing or a drill pipe, in a drill hole.

Such a procedure and such a device are necessary, when in deep drilling the tubing, casing or a drill pipe has become stuck. The jamming of the pipe, which is caused by events which need not be enlarged upon here, can be simply described as undesired jamming in the drill hole. Such a disturbance generally affects only one particular section of a pipe line which may under some circumstances be several thousand meters long.

In order to introduce appropriate measures of drilling technology to free the jammed pipe line, it is necessary to determine the exact area of the pipe where jamming has occurred, using appropriate technical means. In this case it is particularly important to ascertain the upper transition point between jammed and free sections of the pipe, the so called free point.

In such cases as this drill hole probes are introduced which are generally characterized as free point probes. These are let down from above ground inside the drill pipe, consisting of individual pipe sections, on a measuring cable. At a depth to be determined the probe is anchored in the pipe with the help of two groups of moveable arms. When the pipe is pulled on or turned above ground, there follows in the unjammed portion of the pipe line a deformation or torsion of the pipe wall, which brings about a relative motion of the two arm groups of the free point probe with respect to each other. This relative motion is measured by means of an analyzer, the signal is amplified and transmitted above ground by means of the measuring cable.

These free point probes, which have been known for years, have in the course of time been continually improved. Modern developments (e.g. EP 00 39 278, published Aug. 21, 1983, EP 00 55 675, Published Mar. 20, 1985 DE 27 42 590 published Nov. 3, 1983) have already made possible the distinction between torsional and tensile forces applied to the pipe line with rather good sensitivity of the analyzer.

In spite of all improvements, the above-described system for determining the free point, which has been used up to now, has the disadvantage that it only provides information on a point-by-point basis, regarding a particular depth of the pipe. A complete free point determination therefore requires a collection of many individual measurements, whereby for each one not only the anchoring, loosening and moving of the probe, but also the movement of the pipe and the registering of measurement signals are required. On account of the above-described complexity free point measurements in deep drillings have up to now been a very time consuming process.

There was therefore the need for a free point probe, which on the basis of its method of functinn would show not only a significantly reduced time required for measurement, but would also show a significantly improved measurement density.

To achieve the goal described, the invention provides that the jammed pipe is acted upon from above ground by a constant torsional and/or tensile force and that the free point probe of the invention travels through the pipe at an essentially constant speed. The free point probe has one or two magnetostrictive analyzers, which are held by spring pressure against the inner surface of the pipe to be examined. During the travel of the probe, ideally when pulling it up, the compressive and tensile stresses resulting from the forces acting on the pipe are read by the analyzer or analyzers in one area of the inner surface of the pipe and translated into proportional measurement signals. At the same time, the forces acting on the pipe are measured above ground by means of appropriate receptors. The signals thus obtained are registered and corrected above ground by data processing equipment. The results show two independent values of torque and tensile force for a given depth of pipe, in the form of a log.

The free point probe of the invention is formed of an essentially tubular probe housing, in the central axial area of which there is mounted an arm which is capable of being moved to the side. At the outer end of this arm, which is capable of being moved in and out with the aid of a drive system located in the probe housing with integrated spring, there is mounted a pivoting pressure shoe. One or both magnetostrictive analyzers are mounted either directly into the pressure shoe of the moveable arm or into the side of the probe housing diametrically opposed to the exit direction of the arm in such manner, that their axes lie at a right angle to the axis of the probe unit and their faces can be pressed against the inner surface of the pipe to be examined at a preferably small and constant distance from it. In this connection it is advantageous if the faces of the individual analyzers are bent convex in such manner that the radius of curvature approximates half the mean inside diameter of the pipe to be examined and this bent surface lies parallel to the curved surface of the inner wall of the pipe.

The probe housing contains further one sensor each for temperature and pressure for the purpose of correcting drift of the magnetostrictive analyzers, the electronic assemblies for analyzer control, data recording and transmission. In addition there is a casing collar locator, which permits rapid localization of casing shoes or pipe joints without moving the arm out, when the free point probe is lowered into a section of pipe.

The analyzers utilized in the free point probe of the invention work principally according to the magnetostrictive procedure, which represents the state of the art in quasi contactless force measurement in ferromagnetic material. The usual pipe materials fulfill the requirement of ferromagnetic characteristics.

Such a magnetostrictive analyzer is familiar from communication DT 2 335 249 published July 25, 1972. A similar analyzer was described in DE 30 31 997 and in the meantime developed by two firms for use as torque pickups. The measurement principal rests upon the fact that a wave which transmits torque possesses on its surface compressive and tensile stresses. These lie vertically upon one another at an angle of plus or minus 45 degrees to the axial direction. The highest mechanical stresses are present directly on the surface of the wave. The shear stress $\tau$ is directly proportional to torque M and inversely proportional to the third power of wave radius R:

$$\tau = \frac{2}{\pi} \cdot \frac{M}{R^3}$$

The torque analyzer measures the change in permeability which is connected to the mechanical change in stress in the surface of the wave.

This familiar principal is altered for the free point probe of the invention in such manner that now not the shear stress on the surface of a wave that is cause by torsion, but rather that on the inner surface of a pipe is measured. The latter is, to be sure, less than that appearing on the outer surface of a pipe, however this difference is of secondary importance in the case of pipes used in deep drilling on account of the high ratio of diameter to wall thickness.

The shear stress $\tau$ on the inner surface of the pipe is then:

$$\tau = \frac{2}{\pi} \cdot \frac{M \cdot R_i}{R_a^4 - R_i^4}$$

Where:

$\tau$=Shear stress in $Nmm^{-2}$

M=Torque in Nmm $R_a$=Pipe outside radius in mm $R_i$=Pipe inside radius in mm

The analyzer of German patent application DE 30 31 997 published Nov. 3, 1982, which can be typically used for reading this shear stress operating on the inner surface of the pipe, consists of a weakly magnetic shell-type core, which carries on its central pole shoe a primary winding. The outer shell has four slots and carries on each of the four yokes coils, which are crossed to a permeability bridge. The opposing pairs of coils are switched in series and these two pairs are switched against each other. The analyzer is, in order to measure torque, located in the pressure shoe or in the probe housing of the free point probe in such manner, that the diametrically opposed coils with their pole shoes are turned plus or minus 45 degrees with respect to the axial direction of the pipe to be examined. The centrally located primary coil is energized by a generator with high frequency alternating current. The field lines created thereby pass the air gap between the analyzer and the inner surface of the pipe and enter the ferromagnetic pipe material over a certain range. Further out, the field lines pass the air gap once again and return via the four yokes lying on the outside once again to the central pole shoe. If there is no torque the permeability in the pipe inner surface is the same in all directions. Therefore the magnetic flows entering the yokes and the alternating current voltages induced in the coils are also equal, and the output voltage of the coil pairs which are switched against each other is zero. If, however, the pipe is acted upon by torque, then the permeability value for the compressive and the tensile stress directions are different, and a bridge output voltage that is proportional to the shear stress is produced. This voltage is phase-selective rectified, amplified, and transmitted above ground by an appropriate cable matching.

In a similar manner other magnetostrictive analyzers can be used to read stresses in the pipe. The German patent application DT 2 335 249 has revealed an analyzer, the magnetic core of which possesses four identical axial poles, which are located at the corners of an approximately quadratic radial plane. The analyzer possesses four coils, which are wound around two poles each, of which two belong to the energizing circuit and two to the analyzing circuit. The orientation of the sensitive axes which is necessary to measure torque operating on the pipe to be examined leads in this case to a parallel or transverse arrangement, with respect to the axis of the pipe, of the pole pairs, each pole being surrounded by one coil.

The manner of function of magnetostrictive analyzers described up to now concerns the process of reading a torsional force operating on the pipe. Fundamentally speaking, the same analyzers can be used to measure forces operating axially on the pipe, if each analyzer is oriented at an angle of 45 degrees to the arrangement for measuring torque.

For the practical work of determining free points, of course, it is necessary to measure simultaneously and independently not only torsional but also tensile forces operating on the pipe to be examined. This task is fulfilled in the invention by installing two magneto strictive analyzers, one of which, in accordance with the theory given above, is oriented to measure torque, and the other is oriented to measure tensile force.

In a particularly advantageous further development of the free point probe of the invention, using a magnetostrictive analyzer which is the subject of another patent application of this inventor, independent of this (P 35 18 161.3 published Nov. 3, 1982), becomes possible to measure at a single point simultaneously and independently of each other values for torque and tensile force. Such an analyzer has besides its central pole with the energizing coil eight axial poles in a circle around the central pole located at angles of 45 degrees from each other. The accessory coils are so switched that if the analyzer is correctly oriented the measurement signals for torque and tensile force are separate and can be amplified and further processed in separate measurement channels.

A further-refined embodiment of the analyzer which is the subject of the above-mentioned patent application, called component sensor, has besides the central pole with the energizer coil only three additional poles. It can therefore be particularly small in construction and permits use of coils with high numbers of windings and thicker wire. The three coils belonging to the poles lying at angles of 120 degrees from each other in a circle around the central pole are preferably connected in a star circuit. In this manner three signals are produced, which are equivalent to force vectors, and which must first be recomputed, in order to obtain the two values for torque and tensile force. The recomputation requires a precise spatial orientation of the vectors. Therefore, for installation into the free point probe one of the three sensitive axes on the face of the analyzer is taken as an axis of reference. The latter is set at a particular angle to the axis of the analyzer, preferably vertical, parallel, at an angle of plus 45 degrees or at an angle of minus 45 degrees to the axis of the probe housing.

The procedure according to the invention includes also a data processing system above ground. This is connected to the free point probe by means of a cable. Additionally included are the depth indicator of the cable winch, as well as two receptors to measure torque and tension applied to the pipe above ground.

The data processing system includes a memory, into which, before beginning measurement, the data relevant to a magnetostrictive examination of the pipe (e.g. diameter, wall thickness, materials, cold deformability and specific change in permeability of the individual sections of the pipe, as well as the order of installation of the sections and their lengths) are stored. Correctional values for the magnetostrictive analyzer being used with respect to temperature and pressure are also stored in the memory.

During the course of the actual process of measuring, therefore, following a predetermined program, the data sent by the free point probe are corrected, processed and recomputed in a thoroughgoing manner. At the same time, during the travel of the free point probe in the pipe, the correlation of the stored correctional data to the individual sections of the pipe is synchronized by making the shift to the correctional value for the next pipe section in the order follow automatically from the impulse datum arising at every pipe joint. To attain greater freedom from interference impulse data on several data channels simultaneously can be connected to a logical UND-circuit. In addition, the depth of the probe unit which is read continuously during the registration of the free point log, in conjunction with the stored data on the sequence and lengths of the individual sections of the pipe are utilized when the probe passes an arithmetically computable pipe joint to produce a sufficiently wide release impulse. This release impulse is connected to the program logic in such manner that a shift in the correctional data in the data processing system resulting from the impulse datum arising at each pipe joint can only happen once during this release impulse.

The data coming from the free point probe can, in addition, be arithmetically related to the forces acting on the pipe from above ground, since the relationship between the voltages measured by the magnetostrictive analyzer in the pipe and the forces operating on the pipe is approximately linear.

The quantitative data processed and recomputed above ground in the above described manner for the torque and torsional forces operating at the analyzer below ground can now be displayed graphically with a stylus running synchronously with the speed of the free point probe and simultaneously are available in signal memory, along with the other above-mentioned data.

The procedure according to the invention and the device according to the invention for determining the jamming point of a pipe in a drill hole lead to an extreme reduction in the amount of time needed for measurement, in spite of a quasi-infinite number of measuring points. The increase in information over the previous procedure is considerable. The representation of the pipe joints in the measurement curve of the free point log, which permits a very precise correlation of the data with the depth, is advantageous.

Figure 1:
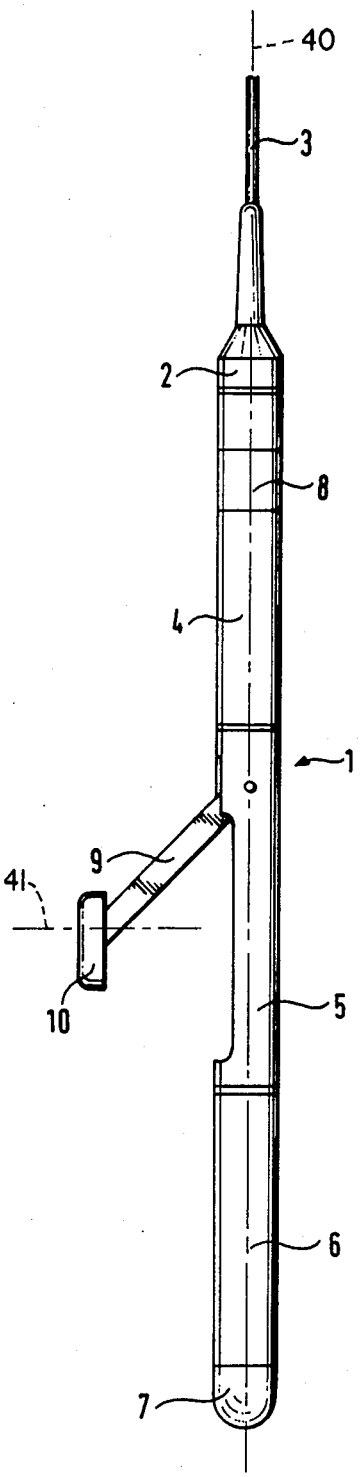
FIG. 1 shows an overall view of the free point probe with partially extended arm.

The free point probe of the invention will be more closely explained in the following with reference to the drawings. FIG. 1 shows an overall view of the embodiment of a free point probe with partially extended arm. The probe housing 1, connected via a cable head 2 with the measurement cable 3, is divided into three essential areas. These are section 4, where the electronic assemblies are located, section 6, where the drive system is located, and section 5 which serves for mounting and storage of the arm 9. A CCL-unit 8 is, in addition, built into the upper section 4. The probe tip 7 can be removed when an extension with a backoff unit is to be attached. The latter is used, in accordance with the present state of technology, to release the free section of pipe from the jammed section by ignition of an explosive charge, while at the same time above ground a left hand torque is applied to the pipe line. Sections 4, 5 nd 6 amounted to be coaxial along probe axis 40. The arm 9 is provided with a pressure shoe 10. The magnetostrictive analyzer which is not drawn is integrated either into the pressure shoe 10 or into the side of the probe housing diametrically opposed to the axial direction of the arm, in section 5. The magnetostrictive analyzer is mounted in pressure shoe 10 with its axis 41 perpendicular to probe axis 40.

Figure 2:
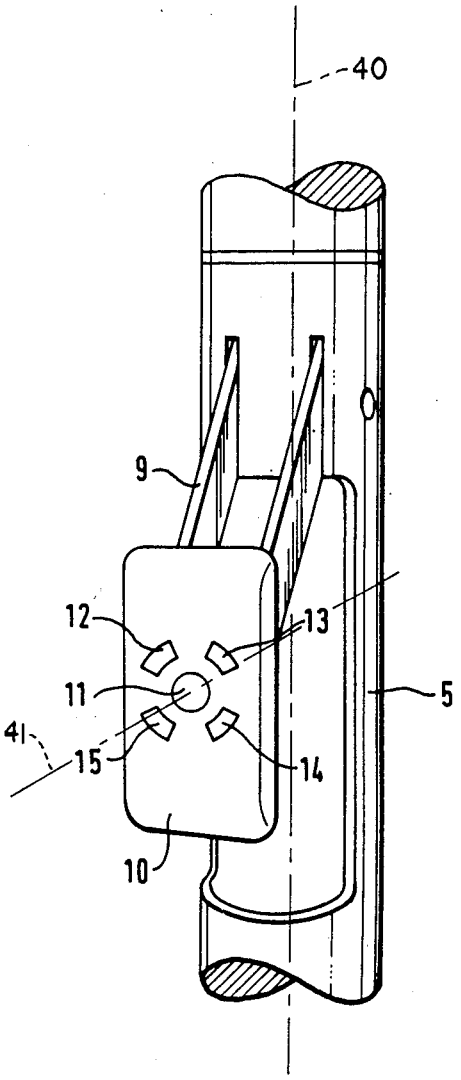
FIGS. 2, 4 and 5 show truncated sections of various embodiments of the invention.

FIG. 2 shows a truncated section of the free point probe with section 5, the arm 9, and the pressure shoe 10. A magnetostrictive torque analyzer is integrated into the pressure shoe 10, only the polar surfaces 11, 12, 13, 14, 15 of which can be seen. The central pole shoe 11 is surrounded by two diametrically opposed pole pairs 12, 14 and 13, 15, whereby the line of connection of each pair corresponds to one of the sensitive axes of the analyzer and describes an angle of plus or minus 45 degrees to the axis of the probe.

Figure 3:
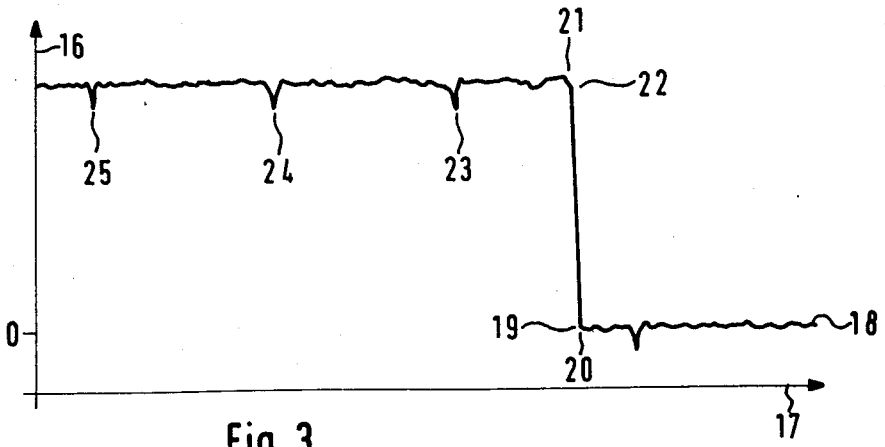
FIG. 3 shows a section of the torque measurement curve of a free point log.

FIG. 3 shows a section of the torque measurement curve of a free point log, as an example. The axis 16 shows the measurement signal corresponding to the shear stress on the inner surface of the pipe, while the axis 17 shows depth. The measurement curve 18 shows in the area of a jammed pipe section a course 19 close to zero. Between the rigid point 20 and the free point 21 there is a shift in level of the shear stress value 22, corresponding to the mechanically induced torsion of the pipe. The pipe joints between the individual pipe sections are indicated by short impulse data 23, 24, 25.

Figure 4:
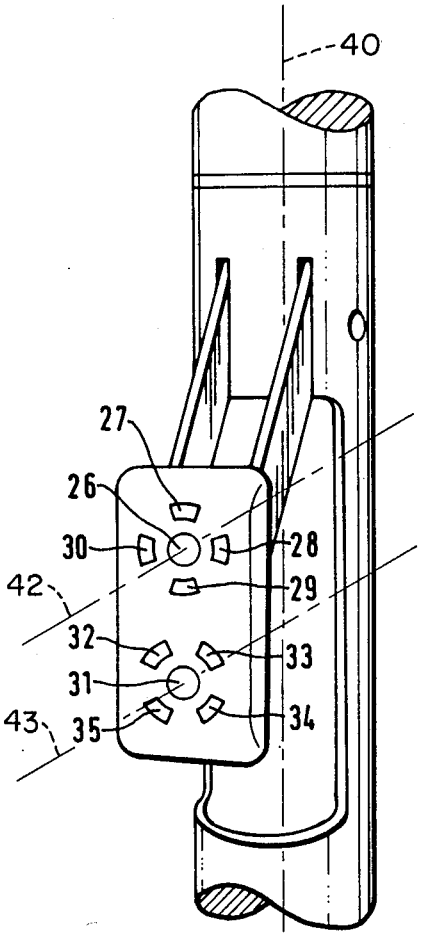

FIG. 4 shows, in an embodiment similar to that of FIG. 2, the orientation of two magneto strictive analyzers in the pressure shoe of the arm, of which the upper one measures the tensile force operating on the pipe and the lower one measures the torque operating on the pipe. The upper analyzer possesses a central pole 26, which is surrounded by the diametrical opposed pole pairs 27, 29 and 28, 30. The sensitive axes of the analyzer, which coincide with the lines connecting the pole pairs, are oriented parallel to the probe axis for the pole pair 27, 29, and at right angles to the pole axis for the pole pair 28, 30. The arrangement of the lower analyzer with its central pole 31 and its polar surfaces 32, 33, 34, 35 corresponds to the arrangement shown in FIG. 2. Axes 42 and 43 of the two magnetostrictive torque analyzers are paarellel to each other and perpendicular to the probe axis 40.

Figure 5:
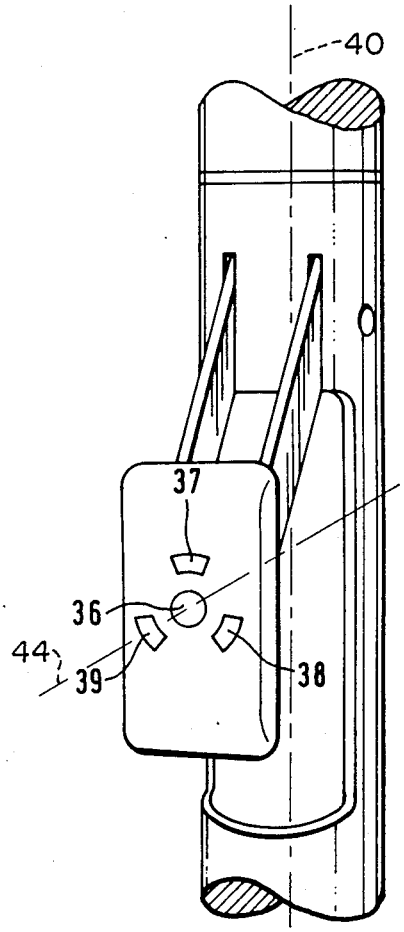

The embodiment shown in FIG. 5 uses a magneto strictive analyzer which is called a component sensor. It possesses three poles 37, 38, 39 arranged around the central pole shoe 36, each at an angle of 120 degrees from the others, the coils of which, which are not shown, are connected in a star circuit. The line connecting the central pole 36 and the outer pole 37 serves as a line of reference and is oriented parallel to the axis of the free point probe. The axial force component of the forces operating on the pipe is therefore to be related to this sensitive axis. The magnetostrictive torque analyzer illustrated in FIG. 5 has an exis 44 that is perpendicular to probe axis 40.

I claim:

1. A procedure for determining the jamming point of a pipe line in a drill hole comprising passing a probe unit through said pipe line at essentially constant speed, said probe unit having a long axis, a magnetostrictive analyzer and a spring biasing said magnetostrictive analyzer against the inner surface of said pipe line with the axis of said magnetostrictive analyzer perpendicular to said long axis, imposing mechanical stress on said pipe line and transmitting the mechanical stresses sensed by said magnetostrictive analyzer in different areas of said pipe line to a data processing means.

2. The procedure of claim 1 wherein said mechanical stress is torque.

3. The procedure of claim 1 wherein said mechanical stress is tension.

4. The procedure of claim 1 wherein said mechanical stress is both torque and tension.

5. The procedure of claim 4 wherein said probe includes two magnetostrictive analyzers, one sensing torque and one sensing tension.

6. The procedure of claim 1 wherein said mechanical stress is increased and decreased in periodic sequence.

7. The procedure of claim 1 including providing a signal to said data processor, said signal showing mechanical stress sensed from a separate analyzer located above ground and producing a synchronous record in said data processing means of the force sensed from said probe and the force sensed from said separate analyzer.

8. The procedure of claim 1 wherein data concerning individual sections of said pipe line and the order of installation of individual sections and their lengths are incorporated into said date processing means.

9. The procedure of claim 8 wherein said magnetostrictive analyzer transmits an impulse datum at each joint between pipe line segments and said data processor correlates data concerning the next consecutive pipe line segment into its record upon receipt of said impulse datum.

10. The procedure of claim 9 wherein said impulse datum is sufficiently wide to be distinguishable from other data transmitted to said date processor.

11. The procedure of claim 1 wherein said probe unit includes a sensor for an ambient condition and means to transmit said condition to said data processor.

12. The procedure of claim 11 wherein said condition is temperature.

13. The procedure of claim 11 wherein said condition is pressure.

14. A free point probe to find the jamming point of a pipe line, said probe having a long axis and comprising: a housing, means for attachment to a cable, an arm extendable radially with respect to said probe axis, a pressure shoe at the end of said arm, a spring to urge said pressure shoe radially outward with respect to said probe axis, a magnetostrictive analyzer mounted on said pressure shoe to confront the inside wall of said pipe line when said arm is extended, the axis of said maagnetostrictive analyzer being perpendicular to said probe axis when said arm is in extended position.

15. The device of claim 14 wherein said magnetostrictive analyzer includes a curved surface and the radius of curvature of said magnetostrictive analyzer is about half the mean inside diameter of said pipe line and the curved surface is parallel to the curved surface of the inside wall of said pipe line.

16. The probe of claim 14 wherein the two sensitive axes of said magnetostrictive analyzer are perpendicular to one another and at a forty-five degree angle from horizontal.

17. The probe of claim 14 wherein the two sensitive axes of said magnetostrictive analyzer are perpendicular to one another and one of said sensitive axes is horizontal.

18. The probe of claim 14 wherein said magnetostrictive analyzer includes three sensitive axes which are oriented one hundred twenty degrees from one another.

* * * * *